US008739860B2

(12) United States Patent
Crawford et al.

(10) Patent No.: US 8,739,860 B2
(45) Date of Patent: Jun. 3, 2014

(54) MECHANICAL ACTUATOR WITH ELECTRONIC ADJUSTMENT

(75) Inventors: Donald Leon Crawford, Spring, TX (US); Daniel F. Dorffer, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 665 days.

(21) Appl. No.: 12/809,454

(22) PCT Filed: Dec. 16, 2008

(86) PCT No.: PCT/US2008/086933

§ 371 (c)(1), (2), (4) Date: Jul. 19, 2011

(87) PCT Pub. No.: WO2009/085732

PCT Pub. Date: Jul. 9, 2009

(65) Prior Publication Data

US 2011/0272145 A1 Nov. 10, 2011

Related U.S. Application Data

(60) Provisional application No. 61/015,035, filed on Dec. 19, 2007.

(51) Int. Cl.
*E21B 23/00* (2006.01)

(52) U.S. Cl.
USPC ..... 166/65.1; 166/381

(58) Field of Classification Search
USPC ..... 166/381, 65.1, 66.4, 250.01
See application file for complete search history.

(56) References Cited

U.S. PATENT DOCUMENTS 6,035,880 A 3/2000 Gazda
6,041,857 A 3/2000 Carmody et al.

(Continued)

FOREIGN PATENT DOCUMENTS

WO 9624747 8/1996

OTHER PUBLICATIONS

International Application No. PCT/US2008/086933 Search Report and Written Opinion dated Jul. 20, 2009.

(Continued)

*Primary Examiner* — Brad Harcourt
(74) *Attorney, Agent, or Firm* — Conley Rose, P.C.

(57) ABSTRACT

An actuation apparatus includes an electronics module (102), an actuator module (104) coupled to the electronics module and electrically communicating with the electronics module, and a motor (112) in the actuator module coupled to a drive member (106), the drive member moveable between a first position and a second position, wherein the movement of the drive member between the first and second positions is adjustable in response to a signal from the electronics module. In some embodiments, the electronics module is operable to adjust a speed of the drive member. The motor may be a brushless direct current motor. In other embodiments, the actuation apparatus (300) includes a processor and a memory, the adjustable drive member is engaged with an actuatable tool (200), the processor receives feedback from the drive member and the tool, and the processor is operable to create a signature in response to the movement of the drive member and compare the signature to a baseline. A method of actuating a tool in a well bore is also disclosed.

22 Claims, 8 Drawing Sheets

(56) References Cited

U.S. PATENT DOCUMENTS

| | | | | |
|---|---|---|---|---|
| 6,070,672 | A | 6/2000 | Gazda | |
| 6,192,988 | B1 | 2/2001 | Tubed | |
| 6,199,628 | B1 | 3/2001 | Beck et al. | |
| 6,310,559 | B1 * | 10/2001 | Laborde et al. | 340/853.2 |
| 7,051,810 | B2 | 5/2006 | Clemens et al. | |
| 2006/0118304 | A1 * | 6/2006 | Ohmer | 166/301 |

OTHER PUBLICATIONS

J. Foster et al.; "Downhole Electro-Mechanical Service Tool Advancements Provide Increased Integrity in HP/HT Environments"; 2006 SPE/ICoTa Coiled Tubing and Well Intervention Conference and Exhibition; Apr. 4-5, 2006; pp. 1-14; SPE 99968; Society of Petroleum Engineers, Inc.; The Woodlands, Texas, U.S.A.

* cited by examiner

MECHANICAL ACTUATOR WITH ELECTRONIC ADJUSTMENT

CROSS-REFERENCE TO RELATED APPLICATIONS

The present application is the U.S. National Stage under 35 U.S.C. §371 of International Patent Application No. PCT/US2008/086933 filed Dec. 16, 2008, which claims the benefit of U.S. Provisional Patent Application Ser. No. 61/015,035 filed Dec. 19, 2007, entitled "Mechanical Actuator With Electronic Adjustment".

STATEMENT REGARDING FEDERALLY SPONSORED RESEARCH OR DEVELOPMENT

Not applicable.

BACKGROUND

After drilling a well that intersects a subterranean hydrocarbon bearing reservoir, a variety of well tools can be positioned in the wellbore during completion, production or remedial activities. For example, temporary packers are often set in the wellbore during the completion and production phases of the well. In addition, various operating tools including flow controllers, plugs, bridge plugs, cement retainers, through tubing bridge plugs, chokes, valves, safety devices, safety valves and the like are often releasably positioned in the wellbore. The tools may be lowered downhole by a wireline or work string. Then, a setting device having moving parts is actuated to engage and fasten the tool to the formation or lined borehole wall.

Such tools can be actuated with an explosive device, and later retrieved or destructed. However, there are hazards and other undesirable consequences of using explosives to actuate the tool. Alternatively, such tools are set and retrieved mechanically via the wireline or work string. A mechanical actuator exerts a mechanical force on the tool to be set. The mechanical actuator may include one structural body moved relative to another structural body. The mechanical force of the actuator can act in different directions, such as longitudinally or axially relative to the well. The mechanical force may be created by surface manipulations. In other tools, a hydraulic force may be exerted on the tool by a fluid under pressure, or by a pressure differential in the tool. In turn, the fluid pressure is used to actuate the tool. In all of these tools, the actuation process is constrained by the downhole environment, wherein pressure, temperature and the overall dynamics of the well produce high levels of uncertainty.

These tools provide little control over and feedback from the actuation process, including the actions of the actuator and the set device, and the final position of the set device. An explosive setting device uses a single, disruptive event to actuate the tool. A hydraulically or mechanically actuated tool performs in such a way that its behavior is predictable at the surface of a well, but sometimes downhole conditions defy prediction and cause the operation to fail in some or all respects. As hydrocarbon development continues to venture into deeper environments, equipment is subjected to more corrosive conditions due to higher temperatures, higher pressures, increasingly corrosive fluids and higher duty cycles. Further, such tools do not provide variable control for adjusting to downhole conditions, or feedback mechanisms for obtaining information during or after the setting operation. If a set device, such as a packer, is not successfully set, little can be known about why, such as whether the actuator or the packer was at fault. As higher quality is demanded of the actuation process and the performance of the device set in the well, current actuation tools are pushed beyond their limits.

BRIEF DESCRIPTION OF THE DRAWINGS

For a detailed description of exemplary embodiments of the disclosure, reference will now be made to the accompanying drawings in which.

DETAILED DESCRIPTION

Figure 1:
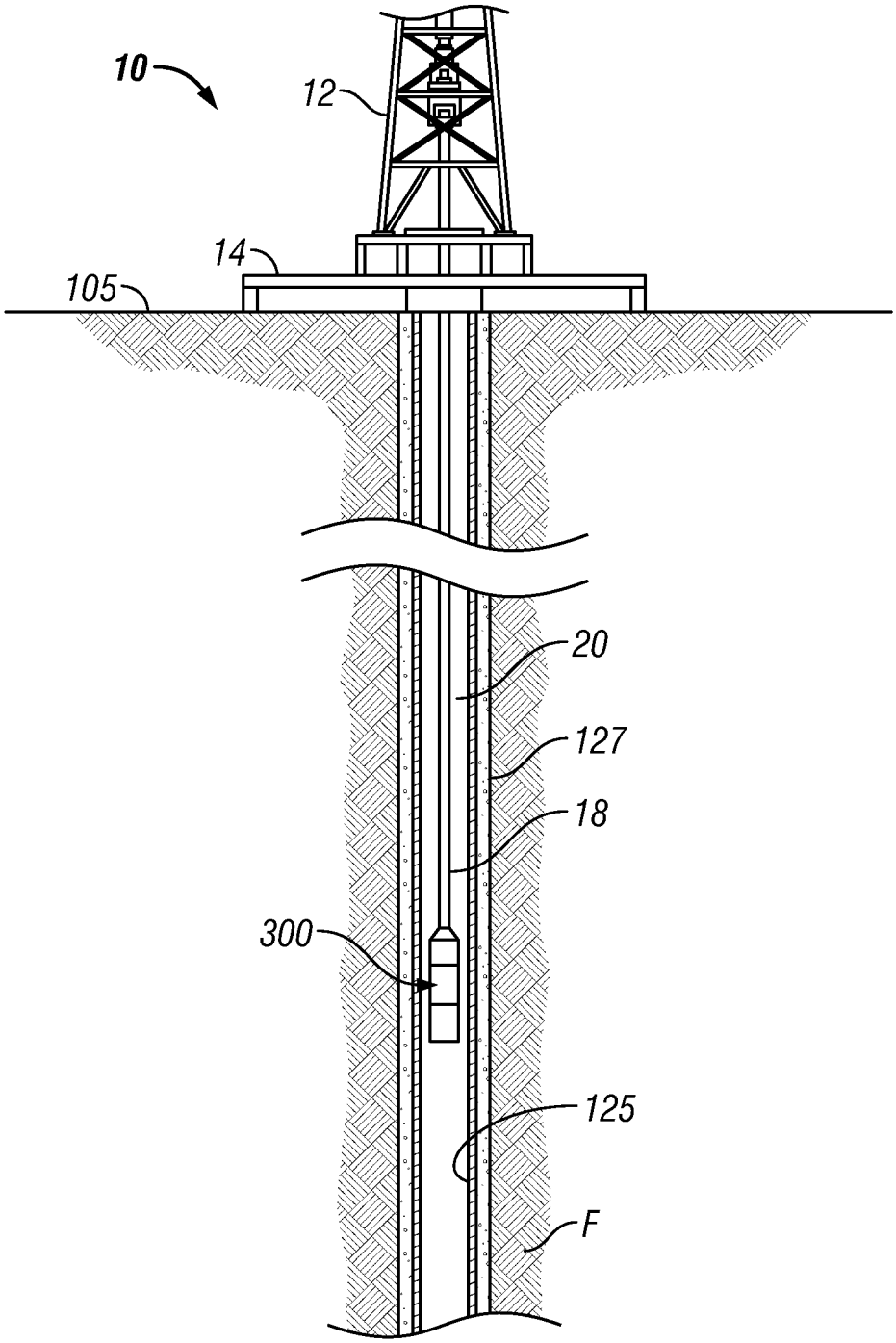
FIG. 1 is a schematic, partial cross-section view of a an operating environment for an actuatable tool.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a schematic representation of an exemplary operating environment for an actuatable tool or assembly 300 is shown. As disclosed below, there are various embodiments of the actuatable assembly 300. For example, the schematic apparatus 300 may include an electro-mechanical actuator and a settable device. Other embodiments may include a power unit. Electrically actuated power units use a conductor in the wireline, if the tool is conveyed by wireline, to accomplish actuation by surface power, after the tool is properly positioned. Alternatively, self-contained downhole power units (DPU) do not require electrical power from the surface and, therefore, permit using a slickline rather than a wireline. The use of a DPU with the actuation apparatus disposed on a slickline may be desirable because this combination provides speed, efficiency of use and increased equipment availability over wireline equipment. Exemplary embodiments of DPUs and associated components, as well as other downhole actuatable tools are found in U.S. Pat. Nos. 6,035,880, 6,070,672, 6,199,628 and 7,051,810.

As depicted, a drilling rig 10 is positioned on the earth's surface 105 and extends over and around a well bore 20 that penetrates a subterranean formation F for the purpose of recovering hydrocarbons. The well bore 20 may be drilled into the subterranean formation F using conventional (or future) drilling techniques and may extend substantially vertically away from the surface 105 or may deviate at any angle from the surface 105. In some instances, all or portions of the well bore 20 may be vertical, deviated, horizontal, and/or curved.

At least the upper portion of the well bore 20 may be lined with casing 125 that may be cemented 127 into position against the formation F in a conventional manner. Alternatively, the operating environment for the assembly 300 includes an uncased well bore 20. The drilling rig 10 includes a derrick 12 with a rig floor 14 through which a work string 18 (e.g., cable, wireline, electric line, slickline, jointed pipe or coiled tubing) extends downwardly from the drilling rig 10 into the well bore 20. The work string 18 suspends a representative downhole actuatable tool 300 to a predetermined depth within the well bore 20 to perform a specific operation, such as setting a packer. The work string 18 may also be known as the entire conveyance above and coupled to the actuatable tool 300. The drilling rig 10 is conventional and therefore includes a motor driven winch and other associated equipment for extending the work string 18 into the well bore 20 to position the actuatable tool 300 at the desired depth.

While the exemplary operating environment depicted in FIG. 1 refers to a stationary drilling rig 10 for lowering and setting the apparatus 300 within a land-based well bore 20, one of ordinary skill in the art will readily appreciate that mobile workover rigs, well servicing units, such as coiled tubing units, and the like, could also be used to lower the apparatus 300 into the well bore 20. It should be understood that the apparatus 300 may also be used in other operational environments, such as within an offshore well bore or a deviated or horizontal well bore.

Figure 2:
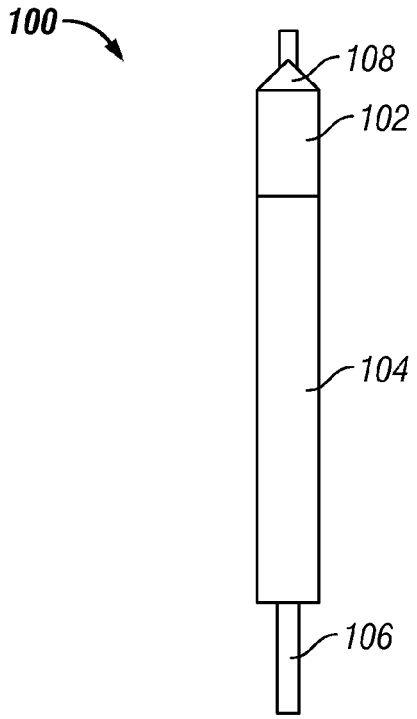
FIG. 2 is a schematic view of an actuator according to principles disclosed herein.
Figure 3:
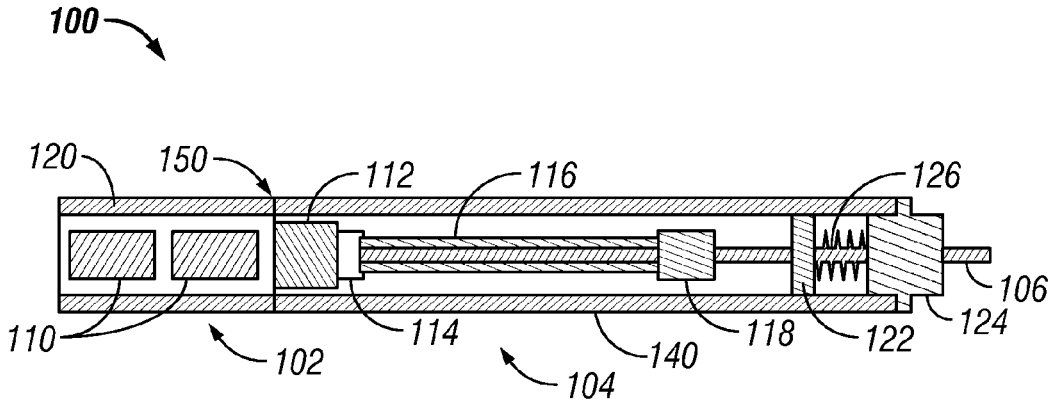
FIG. 3 is a cross-section view of the actuator of FIG. 2.

Referring now to FIGS. 2-5, an actuator portion 100 of the apparatus 300 is shown in more detail. In FIG. 2, a schematic view of the actuator portion 100 is shown. Generally, the actuator portion 100 includes an electronics module 102, an actuator module 104, a power rod or drive shaft 106 and a head 108 for attaching to the cable or string 18. In the cross-section view of the schematic actuator portion 100, as shown in FIG. 3, the electronics module 102 includes a housing 120 containing printed circuit boards 110 or other control, memory and firmware apparatus. A connection mechanism 150 couples the electronics housing 120 to the housing 140 of the actuator module 104. In some embodiments, the module 104 includes an electro-mechanical actuator, or EMA, (i.e., an actuator that electrically powers mechanical movement) having an electric motor 112, a transmission 114, a power sleeve 116, a ball screw assembly 118, the power rod 106, a piston 122, a spring 126 and a lower sub 124.

Figure 4:
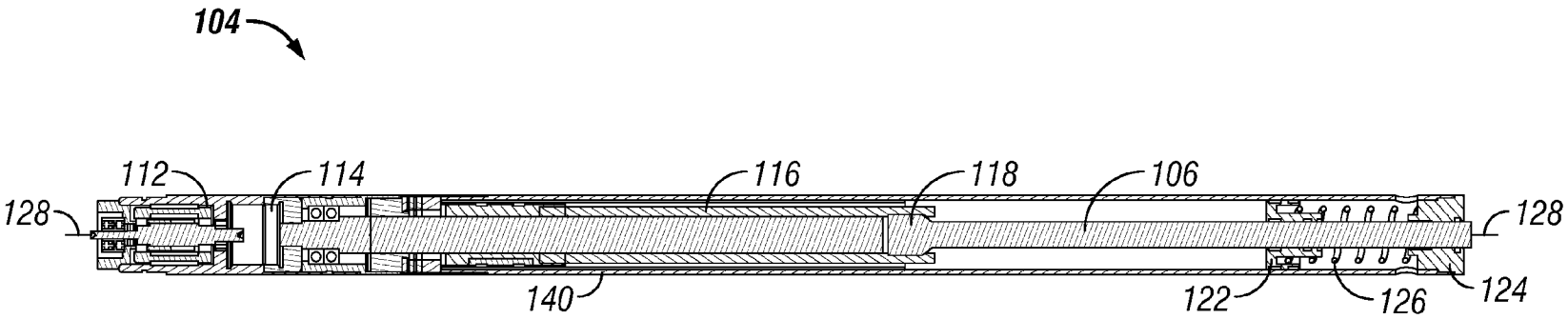
FIG. 4 is a cross-section view of the electro-mechanical actuator module of the actuator of FIG. 2.

Referring now to FIG. 4, a cross-section of an enlarged view of the actuator module 104 is shown. The motor 112 and transmission 114 convert electrical power to the kinetic energy of the moveable power rod 106. The housing 140 and power sleeve 116 contain the power rod 106. The piston 122, the spring 126 and the lower sub 124 are disposed at the lower end of the module 104 to assist with the longitudinal movement of the power rod 106 along the axis 128.

Figure 5:
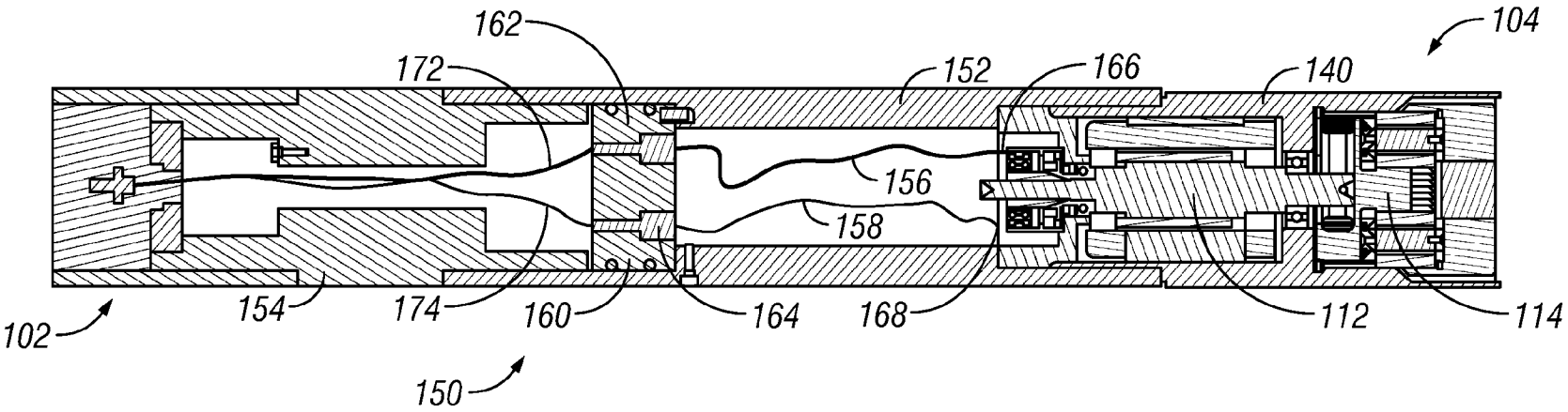
FIG. 5 is an enlarged view of the connector of FIG. 3.

Referring next to FIG. 5, the connection mechanism 150 is shown in enlarged and cross-sectional detail. The connection mechanism 150 couples the electronics module 102 to the actuator module 104. A housing or sub 152 couples to the housing 140 and surrounds electrical contacts 166, 168 adjacent the motor 112. The electrical contacts 166, 168 are coupled to the electrical lines 156, 158 as shown for communication of power and other electrical signals. The electrical lines 156, 158 couple to electrical contacts 162, 164 mounted in a plate 160. The electrical contacts 162, 164 further couple to electrical lines 172, 174. A second housing or sub 154 couples to the sub 152 and the housing 120 of the electronics module 102. The electrical lines extend through the sub 154 to contacts in the electronics module 102. The electrical lines and contacts just described provide one or more electrical paths through the connection between the actuator module and the electronics module, such that power, data and other signals may be communicated through the tool 100. For example, in some embodiments, the circuit boards 110 communicate with the motor 112 and the transmission 114 to control movement of the power rod 106 and to record data from movement of the power rod 106.

Figure 6:
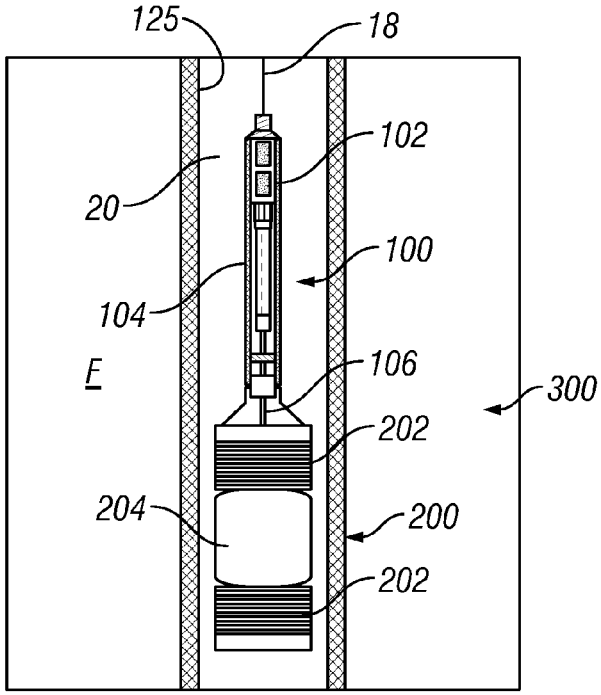
FIG. 6 is a schematic view of an actuatable tool assembly lowered into a well in a run-in position according to principles disclosed herein.

Referring now to FIGS. 6-9, embodiments including the assembly 300 having the actuation portion 100 and the set device portion 200 are shown lowered, positioned and set in a well. With reference to FIG. 6, the assembly 300 is shown schematically in a run-in position in the well bore 20. The actuator 100 is coupled to an actuatable or settable tool 200. In some embodiments, the tool 200 is a packer having slip or anchor elements 202 and an elastomeric element 204. In the embodiment of FIG. 6, the actuator 100 is coupled to the packer 200, and the assembly 300 is suspended and lowered into the well bore 20 via line 18. The packer 200, in the contracted position of FIG. 6, is lowered to a position in the well bore where it is desired to set the packer.

In other embodiments, the set tool 200 includes a wide variety of devices, such as a plug, whipstock plug, electrical tubing puncher, electrical casing puncher, cleanout tool, milling tool and hydroelectrical devices such as a shift sleeve, shift valve, whipstock and those devices used to dump sand, cement, acids and chemicals. Other settable tools are also contemplated and consistent with the teachings herein.

Figure 7:
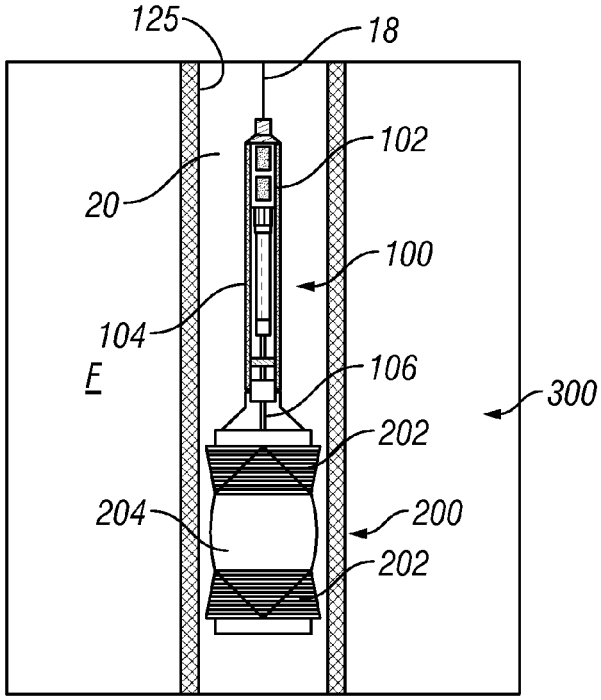
FIG. 7 is a schematic view of the tool assembly of FIG. 6 moved to another position in response to a setting action.
Figure 8:
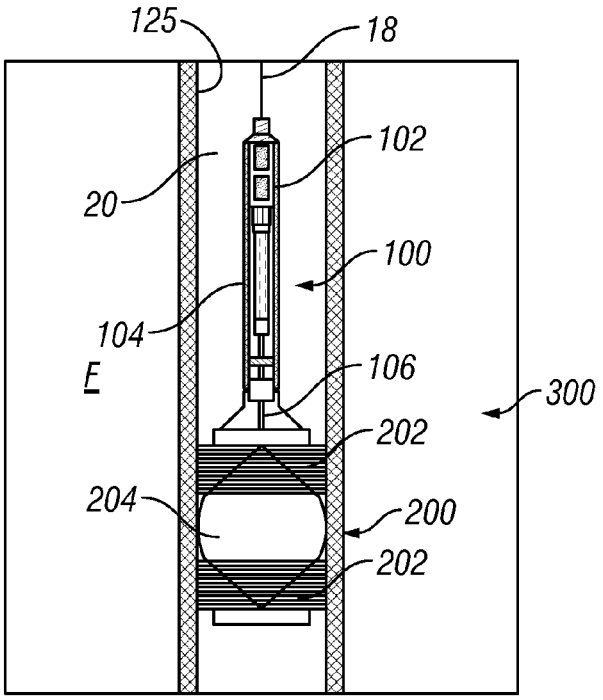
FIG. 8 is a schematic view of the tool assembly of FIG. 6 moved to a further position in response to a setting action.
Figure 9:
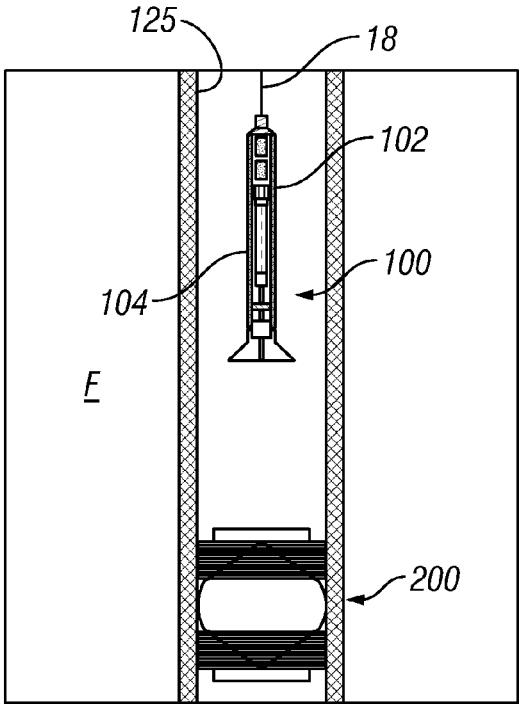
FIG. 9 is a schematic view of the tool assembly of FIG. 6 wherein the settable tool is in a set position and the actuator is disconnected from the settable tool.

Referring to FIG. 7, the actuation process has begun and the packer 200 is beginning to expand to a set position. Upon command, such as from the surface via the line 18 or from the firmware in the electronics module 102, the actuator module 104 is actuated to move the power rod along the axis of the well bore 20. The movement of the power rod 106 engages the packer 200 and initiates expansion movement of the elastomeric element 204 in the packer 200. Expansion of the element 204 causes the slips 202 to move radially outward until the outer portions of the element 204 and the slips 202 engage and set against the casing 125 of the well bore 20 (if the well bore is cased), as shown in FIG. 8. The slips 202 include angled teeth that dig into the casing 125, with the top slip resisting upward movement of the packer 200 and the bottom slip resisting downward movement of the packer 200. The elastomeric element 204 between the slips 202 acts as a spring mechanism storing force and pushing the slips 202 deeper into the casing 125, thereby locking the packer 200 in place. The elastomeric element 204 also seals against the casing 125 in this position. After the packer 200 is set in the well bore 20, the tool 100 may be released from the packer 200 and tripped out of the well bore, as shown in FIG. 9.

It is understood that the EMA tool 100 may be lowered or run into the well via electric line, slickline, coiled tubing, jointed pipe string or other conveyances as represented by the line 18. Further, the EMA tool 100 is adapted for use with various actuatable or settable tools such as plugs, bridge plugs, cement retainers and through tubing bridge plugs. Additionally, the tool 100 included in the assembly 300 with the packer 200 can operate in all downhole environments, and does not require any specific borehole pressure or specific fluid environment, for example.

The electronics module 102 of the EMA tool 100 enables an operator of the assembly 300 to be more involved with the overall setting process. Increased control over the actions of the actuator 104 and the tool 200 is provided, as well as monitoring of the assembly 300 through feedback mechanisms. In some embodiments, the electronics module 102 is adaptable to execute a slow and controlled setting action which results in better set plugs and packers. The controllable electronics module 102 will optimize the setting process, particularly for a packer with an elastomeric element because elastomers react well to some forces but not others. The speed and force applied to the elastomer can be optimized to the level of highest storage of energy in the elastomeric element. This translates into a more reliable, longer lasting and stronger setting of the packer. Further, in some embodiments, the electronics module 102 is adapted to receive and process feedback and record the setting signature for process enhancements, as will be more fully described below.

In some embodiments, the actuator and packer assembly 300 requires setting parameters to predetermine the movements of the tool, thereby avoiding anticipated problems and ensuring proper setting. Setting parameters may include speed, force and other similar parameters. The speed of the power rod 106, for example, is directly measured. A force in the rod 106 can then be derived from the current and voltage used in the brushless direct current (BLDC) motor 112 that propels the actuator and moves the power rod 106. In some embodiments, the setting parameters are determined at the surface of the well before the tool is lowered into the well. In some embodiments, the electronics module 102, including firmware, processors, memory and controllers (represented by the boards 110 in the module 102), is adapted to be controlled while in the well and during the setting process shown by FIGS. 6-9. In some embodiments, the setting process is controlled manually by operator interaction via the line 18. In further embodiments, feedback mechanisms enhance the controllable and adaptable actuation and setting process. The feedback mechanisms are pre-programmed in the electronics module 102 in some embodiments, and automated for the job conditions at hand. In other embodiments, the feedback mechanisms are handled manually via operator interaction.

To configure the assembly 300 for adjustable setting actions and responses to setting feedback, the drive mechanism for the actuator must be adaptable. Certain motors, such as a brushed DC motor, for example, are limited in their capabilities. A brushed DC motor is limited by its supply voltage, which reduces the speed provided to the power rod (e.g., a maximum of 0.5 inches per minute) and eliminates control capability (i.e., the motor is powered on or off). A brushed DC motor does not provide a force feedback mechanism. A brushed DC motor also requires a controlled gaseous environment, wherein the pressure ratings are limited and force calculations are not possible. While some embodiments herein include an adapted brushed DC motor, increased capabilities are provided as described below.

The brushless direct current (BLDC) motor 112 is able to create bi-directional movement of the rod 106 upon command from the electronics module. If the power rod 106 is run to the end of its stroke, the BLDC motor 112 is capable of resetting the power rod 106 without tripping the EMA tool 100 to the surface. The BLDC motor 112 operates on a known absolute current, which can be used to calculate a force response in the motor. The calculated force from the current draw on the motor 112 can be obtained in real time or after the setting event via memory tools, as further explained with reference to the various embodiments herein. The BLDC motor 112 can be adjusted by digital control from the electronics module, providing increased and adjustable speed in the power rod (e.g., 1.25 inches per minutes) and increased control capabilities. In addition, the BLDC motor 112 may be submerged in an oil chamber shared with the mechanical parts of the EMA tool 100 to eliminate the pressure rating limitations and provide force calculation opportunities. The present disclosure further contemplates other motors consistent with the principles and embodiments described herein.

In operation, the embodiments described are configurable to execute different setting actions. For example, in some embodiments, an increased rate of displacement of either the power rod or the expandable packer can be executed for the first portion of the setting action. This process may also be referred to as "rapid action." In some embodiments, the first portion of the setting action may be as much as 50% of the total displacement of the power rod or the expandable packer. In other embodiments, the displacement may be as much as 75% or 80% of the total displacement of the set rod and/or packer. The first portion of the setting action may be followed by a second portion including slower action or rate of displacement for the final phase of the setting action. Such a combined rapid then slowed setting action by the actuator and packer tool allows for a better setting action for the packer, as well as the opportunity to capture setting parameters at different rates of displacement for better monitoring or analysis. The response of the tool to the different speeds of setting can be recorded by the electronics module, then monitored and/or analyzed for information that will enhance future setting actions.

The controllable and programmable apparatus in the electronics module, such as boards 110 and also known as "smart electronics," also allow capturing key downhole parameters. In some embodiments, the electronics and firmware communicate with sensors disposed about the tool 100 and elsewhere. For example, during operation of the tool 300, depth correlation sensors, temperature sensors and pressure sensors may be sampled to measure downhole environment parameters. Further, the tool 100 takes accurate internal measurements such as the displacement of the power rod used to set the packer or plug, or the force applied to the rod. The information from these samplings and measurements is captured in the downhole firmware for later retrieval at the surface in some embodiments, or is captured real time and communicated to the surface via line 18 or other means, such as telemetry.

In some embodiments, the actuator and packer experience minute changes in force and rate of displacement during operation. The tool 300 not only allows recording of this information by the electronics module 102, but also the means for independently monitoring, analyzing and using the information to correlate such changes. As previously described, communication between the electronics module 102 and the EMA 104 is achieved via the connector 150, as described with reference to FIG. 5. Therefore, proactive and intelligent interaction between the surface and the downhole setting action is achieved, and the actuator is integrated with the controllers, processors and firmware in the electronics module 102 and circuit boards 110 therein.

Figure 10:
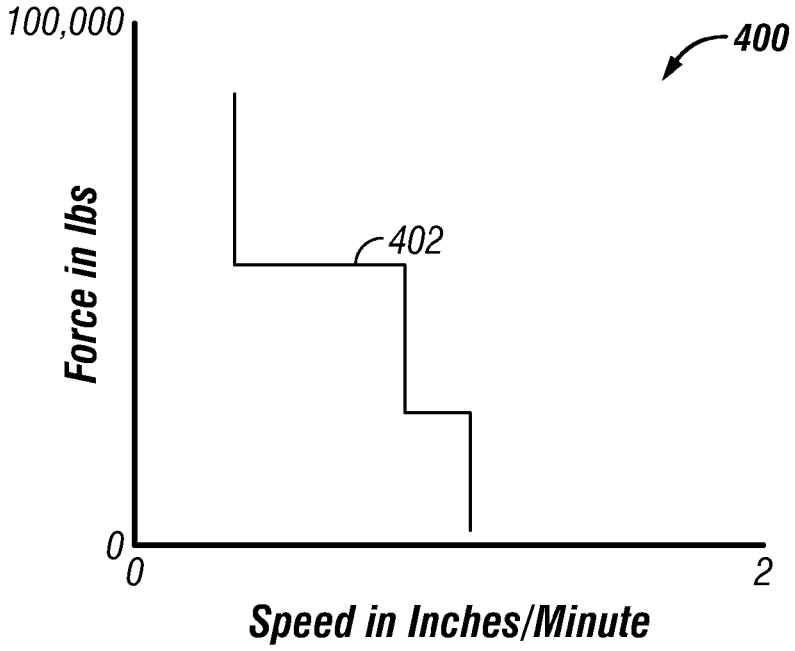
FIG. 10 is a graphical representation of information captured by and from the actuatable tool according to principles disclosed herein.

In further embodiments, the EMA tool 100 captures the behavior or signature of the packer or other settable device in a given environment. For example, speed of the actuator rod 106 versus force on the rod may be recorded and analyzed. Referring to FIG. 10, a graph 400 shows the speed in inches per minute against the force in pounds of an exemplary operation of the tool 300. The graph 400 may be recorded as a signature of the tool, particularly a signature of the set device 200. Such a signature may be compared with a baseline or historical signature for the particular type of device 200 used in the subject environment. The baseline may be stored in a memory 110 in the electronics module 102, or at the surface of the well for comparison when the signature is sent to the surface by the tool. From this comparison, proper setting of the packer 200 can be illustrated for troubleshooting the packer or setting thereof.

In other embodiments, the graph 400, captured and recorded by the electronics described herein, documents events that might help diagnose the functionality of the packer, differentiating between packer behavior and borehole-induced events (e.g., corroded casings or non-uniform casing cross-section). The graph 400 further represents the adjustable operation of the tool 300 as previously described, wherein the force and speed of the power rod or packer are adjusted during the overall setting action. The various fluctuations of a line 402 in the graph 400 show that speed can be controlled on command to ensure an optimal setting of the packer, or that the force being stored in the rubber packer elements can be observed. The later part of the curve shows that speed of travel of the power rod can be slowed to allow optimal settle of the stored energy in the packer elements.

Figure 11:
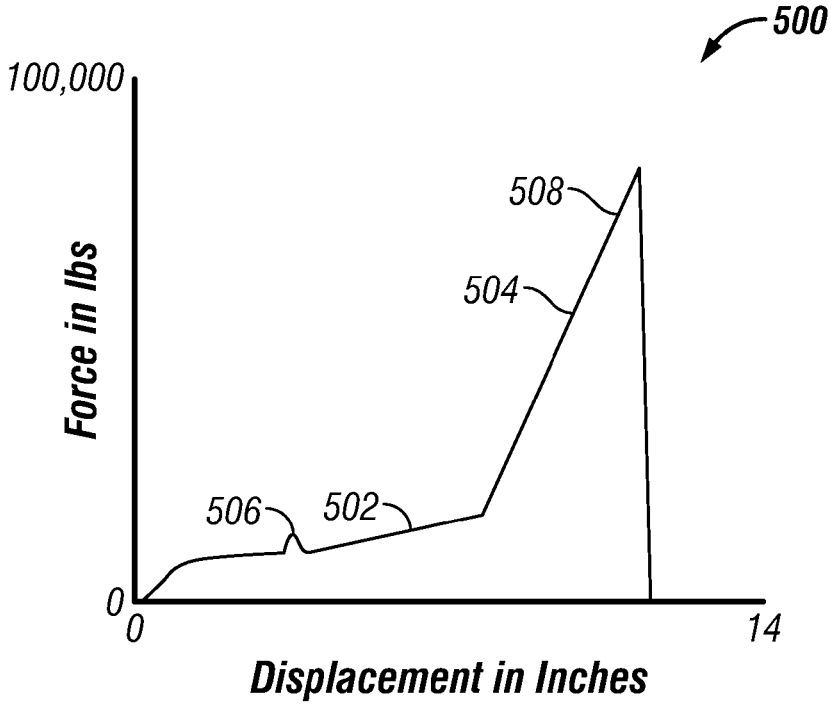
FIG. 11 is another graphical representation of information captured by and from the actuatable tool.

In still further embodiments, other parameters of the setting action may be recorded and analyzed as just described. For example, with reference to FIG. 11, the displacement in inches is compared against the force in pounds, represented by a graph 500. A curve 504 includes a first shallow curve 502 followed by a second steep curve 508. The first curve 502 includes an anomaly 506. The total curve 504 represents a signature of the packer set in a particular environment. The embodiments of the invention described herein allow use of this signature to enhance later setting actions, through quality control and development of a database including actual downhole output.

Figure 12:
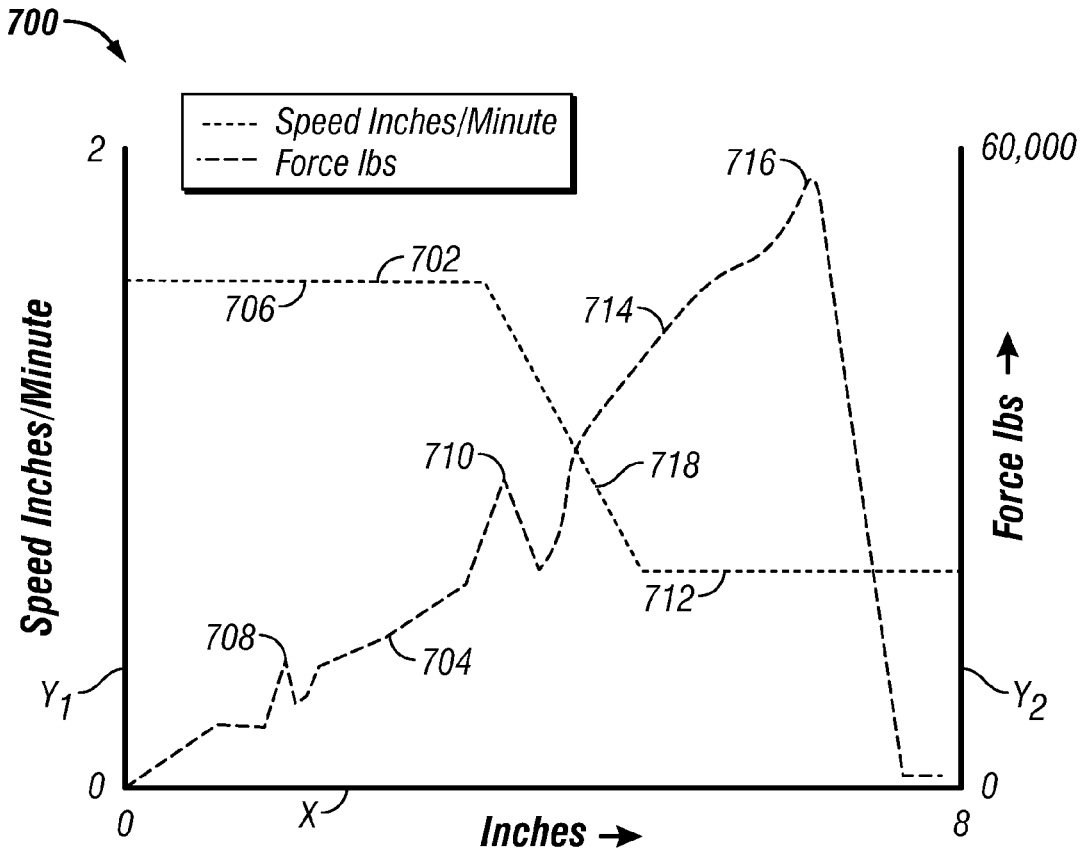
FIG. 12 is yet another graphical representation of information captured by and from the actuatable tool.

With reference to FIG. 12, operations of other embodiments of the EMA used with a set device, i.e., the assembly 300, are shown using graphical representation 700 including curves 702 and 704. The graph 700 includes an axis X representing inches of displacement of the EMA's power rod. An axis $Y_1$ represents speed in inches per minute of the power rod while another axis $Y_2$ represents force in pounds of the power rod. It is understood that the axes X, $Y_1$ and $Y_2$ may also represent the same units of measurement with respect to the packer or other set device. Displacement, speed and force of the packer are directly proportional to those of the actuator rod, and such measurements for the packer can be calculated from the rod movement and feedback.

Still referring to FIG. 12, in operation, an EMA assembly as described herein is set in the well. Upon command, the EMA is actuated and the power rod begins to move at a high or full speed 706 as shown on the curve 702. The speed 706 can be 1.5 inches per minute, for example. During the high speed portion 706, a safety shear member on the upper slip of the packer breaks, creating a low end peak 708 in force. At this stage, a minimal amount of energy is being stored in the rubber elastomer element of the packer, until the force of the safety shear member coupled to the lower slip is overcome. A force peak 710 is created when the shear member on the lower slip breaks. Immediately after the lower shear member breaks and force peak 710 occurs, the speed of the actuator rod is reduced, shown by a curve portion 718, until a lesser speed 712 is settled upon. Next, the reduced speed 712 movement of the power rod takes advantage of the movement or "flow" of the elastomeric element to store the maximum amount of energy in the packer, represented by a curve portion 714. When the stored force in the elastomeric element exceeds the coupling force of a release shear member, the actuation tool shears from the packer, represented by force peak 716, and leaves the set packer behind in the well, as shown in FIG. 9.

A packer, such as the packer 200, may include a set of slips on the uphole and downhole sides of a rubber element, such as the slips 202 and elastomeric element 204, respectively. The rubber element may be used to seal against the formation or the casing, and to act like a "spring" that stores force to push against the upper and lower slips to keep them firmly engaged with the formation or casing. The rubber element can be equated to a viscous fluid, and reacts accordingly to the actuation movements applied by the actuator to the packer. Therefore, if a significant force is applied quickly to the rubber element, it, like a viscous fluid, will resist the force to the detriment of a successful actuation of the packer. After a period of time, the rubber element will relax and "flow," reducing the stored force. By varying the setting speed of the actuator power rod and the force applied thereby, the setting time in the latter stages of the setting operation can be maximized to allow the rubber time to flow. These actions will store the maximum possible amount of force in the rubber element before the actuation tool is sheared from the packer.

The embodiments of the EMA tool 100 used with the assembly 300 allow use of a rapid conveyance system (e.g., electric line or slickline) in hostile conditions such as deep and/or high temperature environments, whereas, currently, pipe conveyed tools and mechanical actuation are absolutely required in such environments. Furthermore, the embodiments of the EMA 100 and assembly 300 can be operated as illustrated by the graphical representations of FIGS. 10-12. The parameters illustrated in the graphs can be adjusted based on predicted downhole conditions and the known specifications of the set device. Additionally, feedback from the actual setting operation can be recorded and monitored. Curves can be established based on recorded data, and the curves can be compared to signatures for enhancements to the setting operation. Consequently, feedback can be obtained for quality control purposes and the feedback can be captured to develop a database. Such information can then be used to adjust the controlled setting operation via the electronics module 102 of the EMA tool 100. Thus, significant rig time savings due to decreased tripping time is achieved.

The above discussion is meant to be illustrative of the principles and various embodiments of the disclosure. Numerous variations and modifications will become apparent to those skilled in the art once the above disclosure is fully appreciated. For example, embodiments may include various actuators or plugs and packers, or various electronics in a controllable and programmable module adapted for communicating with the electro-mechanical actuator, consistent with the teachings herein. It is intended that the following claims be interpreted to embrace all such variations and modifications.

What is claimed is:

1. A downhole actuation apparatus comprising:

an electronics module;

an actuator module coupled to the electronics module and electrically communicating with the electronics module; and a motor in the actuator module coupled to a drive member, the drive member moveable between a first position and a second position;

wherein the movement of the drive member between the first and second positions is adjustable while the drive member is in motion in response to a signal from the electronics module.

2. The apparatus of claim 1 wherein the electronics module is operable to adjust a speed of the drive member.

3. The apparatus of claim 1 wherein a single movement between the first and second positions includes at least two speeds of the drive member.

4. The apparatus of claim 1 wherein the motor is a brushless direct current motor.

5. The apparatus of claim 1 wherein the electronics module is operable to receive a feedback from the motor.

6. The apparatus of claim 5 wherein the feedback includes a force on the drive member calculated from a current in the motor.

7. The apparatus of claim 1 further comprising a tool engaged with the drive member and actuatable in response to movement of the drive member.

8. The apparatus of claim 1 further comprising an electrical connector coupling the electronics module and the actuator module.

9. The apparatus of claim 1 wherein the electronics module further includes a processor and a memory.

10. The apparatus of claim 9 wherein the processor communicates with a surface of a well, and the signal is communicated from the surface to the motor via the processor to adjust the movement.

11. The apparatus of claim 9 wherein the signal is stored in the memory and communicated to the motor via the processor to adjust the movement.

12. The apparatus of claim 9 wherein the processor is operable to create a signature in response to the movement and compare the signature with a baseline stored in the memory.

13. A downhole actuation apparatus comprising:

an electronics module having a processor and a memory;

an actuator module coupled to the electronics module and electrically communicating with the electronics module;

an adjustable drive member moveably supported by the actuator module between a first position and a second position; and an actuatable tool engaged with the drive member, the actuatable tool moveable in response to movement by the drive member;

wherein the processor is operable to create a signature of the movement of the actuatable tool while the actuatable tool is in motion in response to the movement of the drive member and compare the signature to a baseline movement of the actuatable tool.

14. The apparatus of claim 13 further including a brushless direct current motor coupled to the drive member, and wherein the signature is a force response in the actuatable tool derived from an operating current of the brushless direct current motor.

15. The apparatus of claim 13 wherein the baseline is stored in the memory or at a surface of the well.

16. The apparatus of claim 13 wherein the processor is operable to adjust the movement of the drive member in response to the comparison.

17. A method of actuating a tool in a well bore comprising:

lowering an actuator coupled to the tool into the well bore;

moving a drive member in the actuator;

adjusting the movement of the moving drive member while in motion; and actuating the tool in response to the moving and the adjusting.

18. The method of claim 17 wherein the adjusting comprises changing a speed of the drive member during the moving of the drive member to optimize the actuating of the tool.

19. The method of claim 17 wherein the adjusting comprises changing a force of the drive member during the moving of the drive member to optimize the actuating of the tool.

20. The method of claim 17 further comprising receiving a feedback from the moving of the drive member before adjusting the moving of the drive member.

21. The method of claim 17 further comprising:

capturing a signature of the tool in response to the actuating; and comparing the signature to a baseline of the tool.

22. The method of claim 21 further comprising adjusting the moving in response to the comparison of the signature to the baseline.

* * * * *